United States Patent [19]

Secrist

[11] 4,056,335

[45] Nov. 1, 1977

[54] SUBSURFACE PUMPING INSTALLATION FOR HANDLING VISCOUS OR SAND-LADEN FLUIDS

[75] Inventor: Walter S. Secrist, Dallas, Tex.

[73] Assignee: United States Steel Corporation, Pittsburgh, Pa.

[21] Appl. No.: 653,425

[22] Filed: Jan. 29, 1976

[51] Int. Cl.[2] ..... F04B 39/00

[52] U.S. Cl. ..... 417/431

[58] Field of Search ..... 417/431, 432, 92, 76; 92/86.5, 162

[56] References Cited

U.S. PATENT DOCUMENTS

| | | | |
|---|---|---|---|
| 723,676 | 3/1903 | Jones | 417/76 |
| 1,340,545 | 5/1920 | Johnson | 417/432 |
| 1,550,767 | 8/1925 | Weaver | 92/162 |
| 1,554,691 | 9/1925 | Reardon | 417/431 |
| 1,579,734 | 4/1926 | Pearson | 417/92 |
| 1,597,161 | 8/1926 | Kellogg et al. | 92/86.5 |
| 2,404,930 | 7/1946 | Smith | 417/432 |
| 2,480,969 | 9/1949 | Rosa | 417/76 |
| 3,229,900 | 1/1968 | McCrory et al. | 92/86.5 |
| 3,802,802 | 4/1974 | Greer | 417/431 |

*Primary Examiner*—William L. Freeh
*Attorney, Agent, or Firm*—Walter P. Wood

[57] ABSTRACT

A subsurface pumping installation for handling viscous or sand-laden fluids. The installation includes parallel power and production tubing strings, a pump located at the bottom of the power tubing string, and a crossover which affords communication between the pump and the production tubing string. Diluent is conducted to the well through the power tubing string. A portion of the diluent is conducted to the pump barrel below the plunger, where it serves to exclude well fluid from the plunger. Another portion may be conducted through a bypass tube to a mixing chamber below the pump, where it mixes with well fluid.

16 Claims, 10 Drawing Figures

FIG. 2.
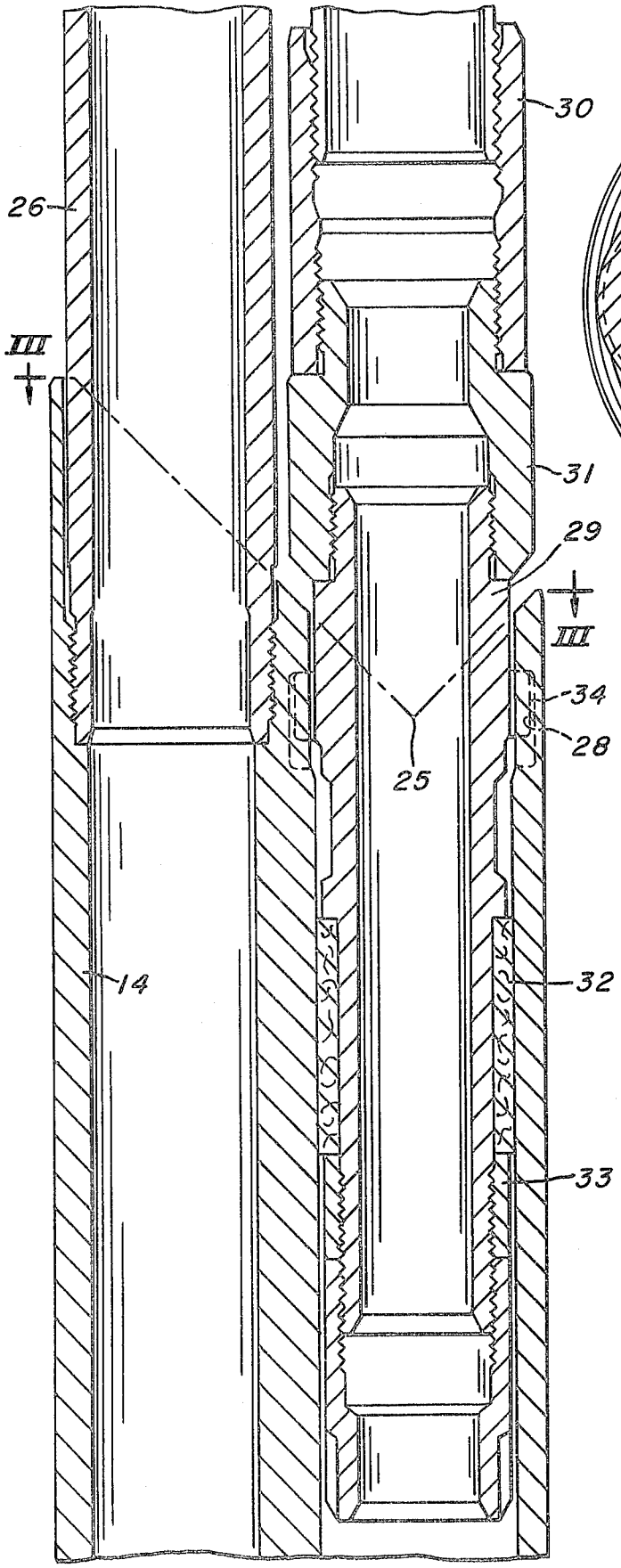
FIG. 3.
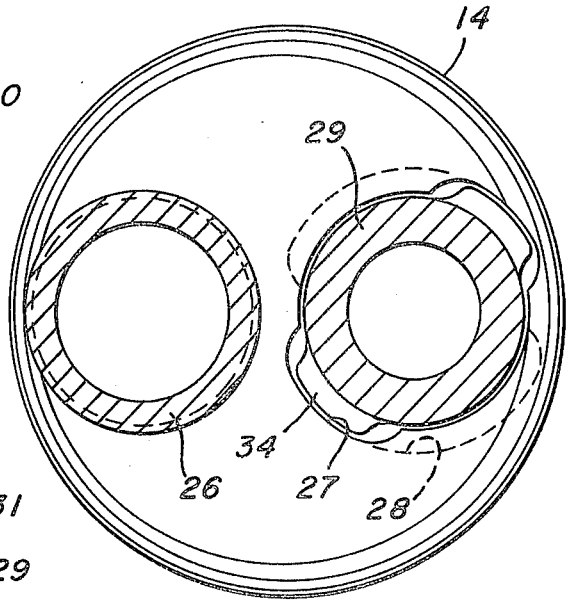
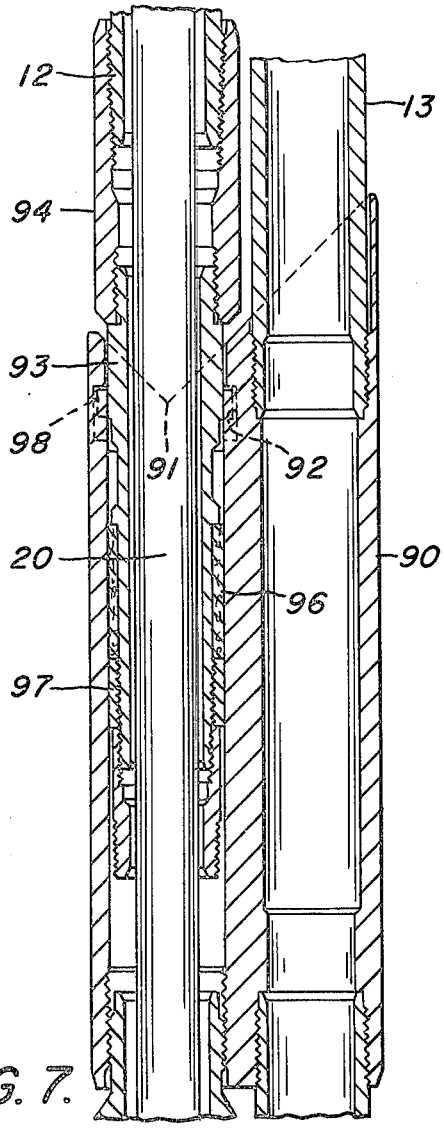
FIG. 7.

SUBSURFACE PUMPING INSTALLATION FOR HANDLING VISCOUS OR SAND-LADEN FLUIDS

This invention relates to improved subsurface pumping installations for handling viscous or sand-laden fluids.

In pumping viscous or sand-laden fluids from a well, it is known to introduce solvents or diluents to the well from the surface. The diluent blends with the well fluid and enables it to be pumped to the surface more readily. It is known to employ parallel power and production tubing strings which extend into the well within a common casing. The power tubing string accommodates sucker rods for operating a pump located at the bottom of this string. The power tubing string also carries diluent from the surface into the well, either directly or through hollow sucker rods. The production tubing string communicates with the pump through a crossover and carries a mixture of well fluid and diluent to the surface. Reference can be made to Davis U.S. Pat. No. 3,098,452 or Greer U.S. Pat. No. 3,802,802 for exemplary showings of a pumping installations of this type.

Pumping installations of this type used heretofore have been unduly complex with many expensive parts, and have been difficult to maintain and repair. In theory the well fluid is kept out of contact with the pump plunger, but sometimes the well fluid may contain as much as fifty percent by volume of sand, and conditions are such that large volumes of which may be drawn into the working parts of the pump. Excessive time is required to desand the pump before servicing and repairs even can be started. When the parts are retrieved from the well, usually the tubing strings and sucker rods must be pulled "wet", that is without draining the tubing, which not only is an awkward operation, but causes objectionable oil spills on the ground above the well.

An object of the present invention is to provide an improved pumping installation of the foregoing type which largely overcomes these disadvantages; that is, in which the installation is simpler mechanically and the parts can be installed in a well or retrieved therefrom more readily.

A further object is to provide an improved pumping installation of the foregoing which permits the tubing to be drained before the parts are retrieved from the well.

A further object is to provide an improved pumping installation which is fully effective in keeping well fluid out of contact with the working parts of the pump.

In the drawings:

FIG. 2 is a vertical sectional view of one form of landing shoe and parts connected thereto which may be embodied in the installation;

FIG. 3 is a horizontal section on line III—III of FIG. 2.

Figure 4:
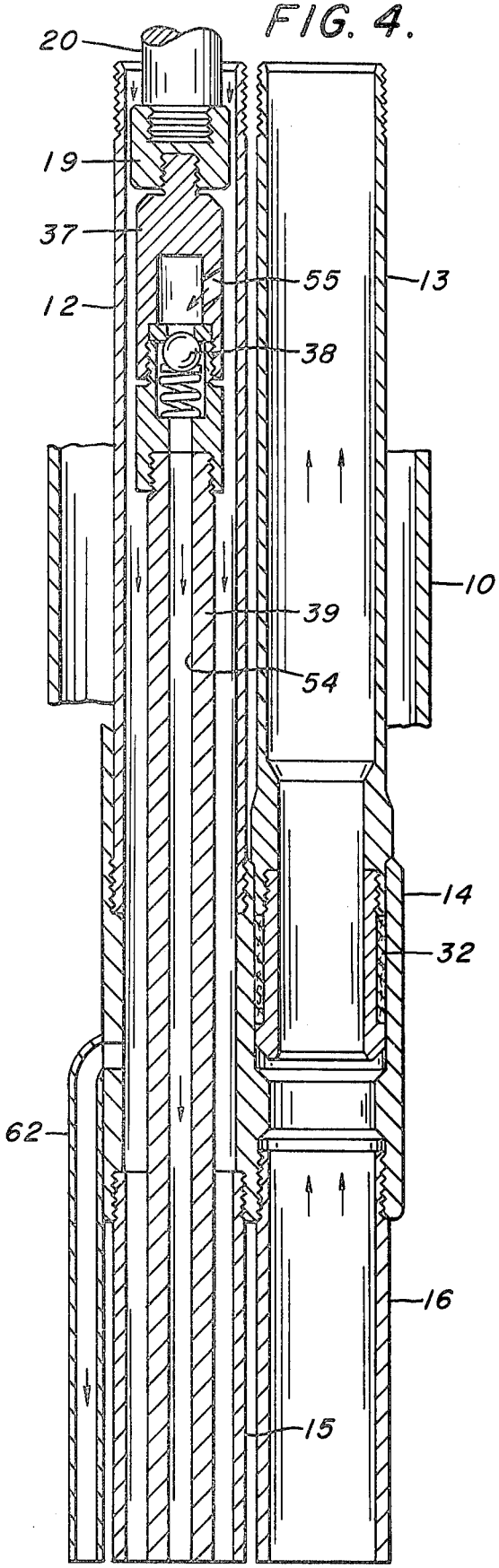
Figure 4A:
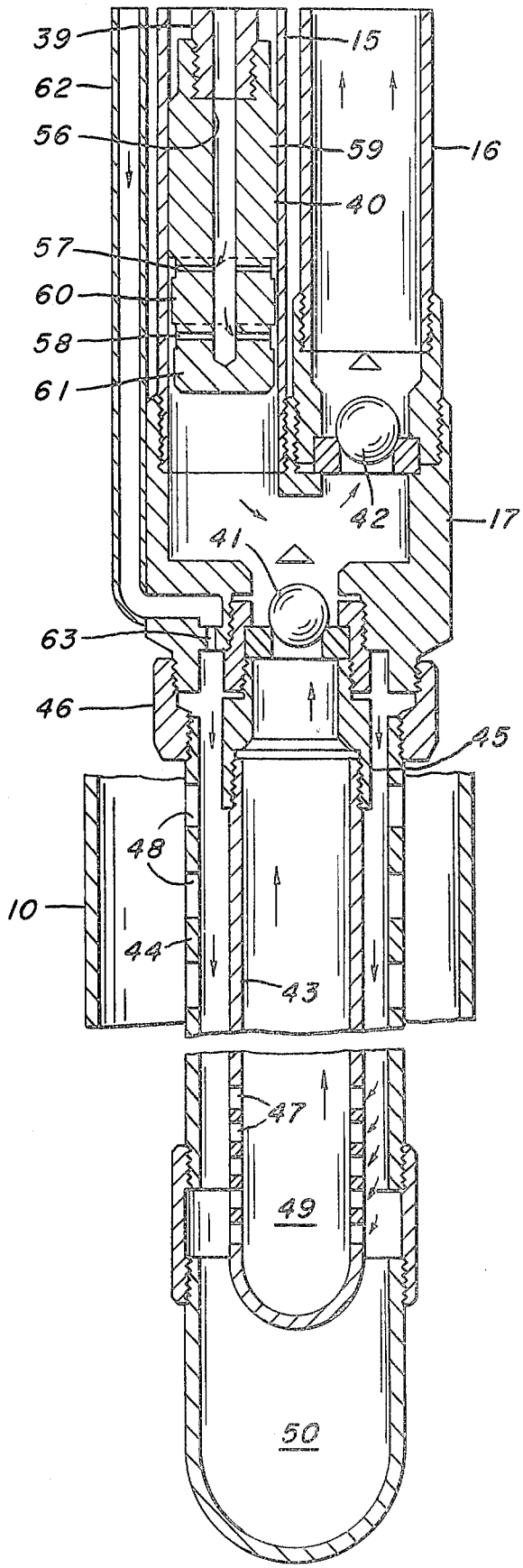
Figure 5:
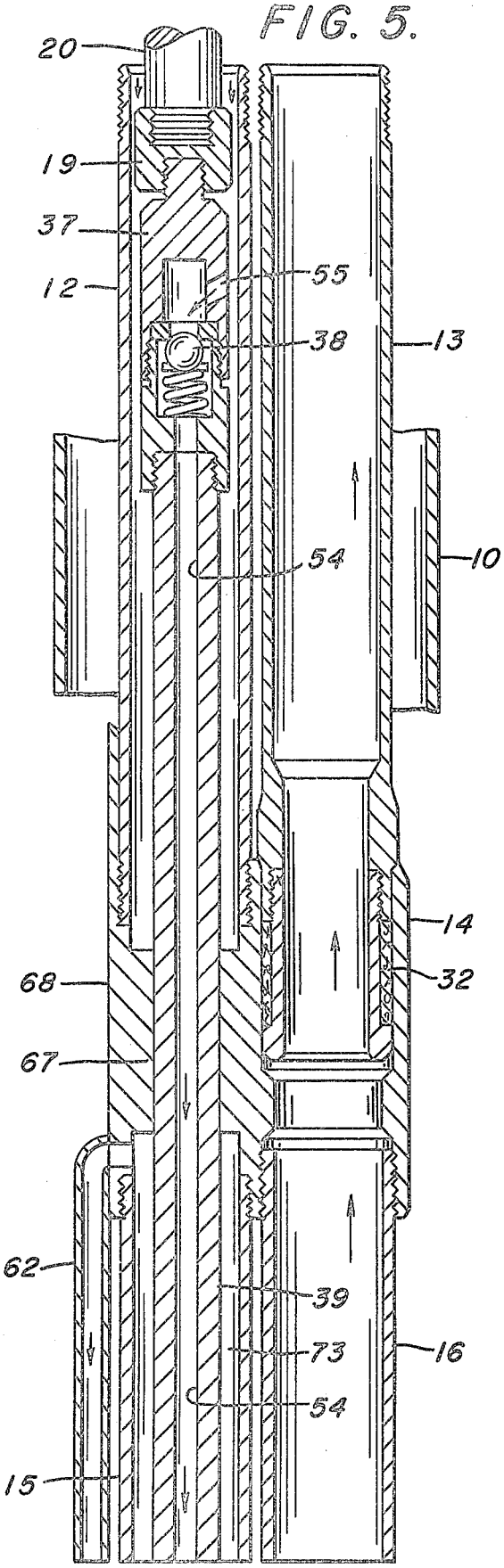
Figure 5A:
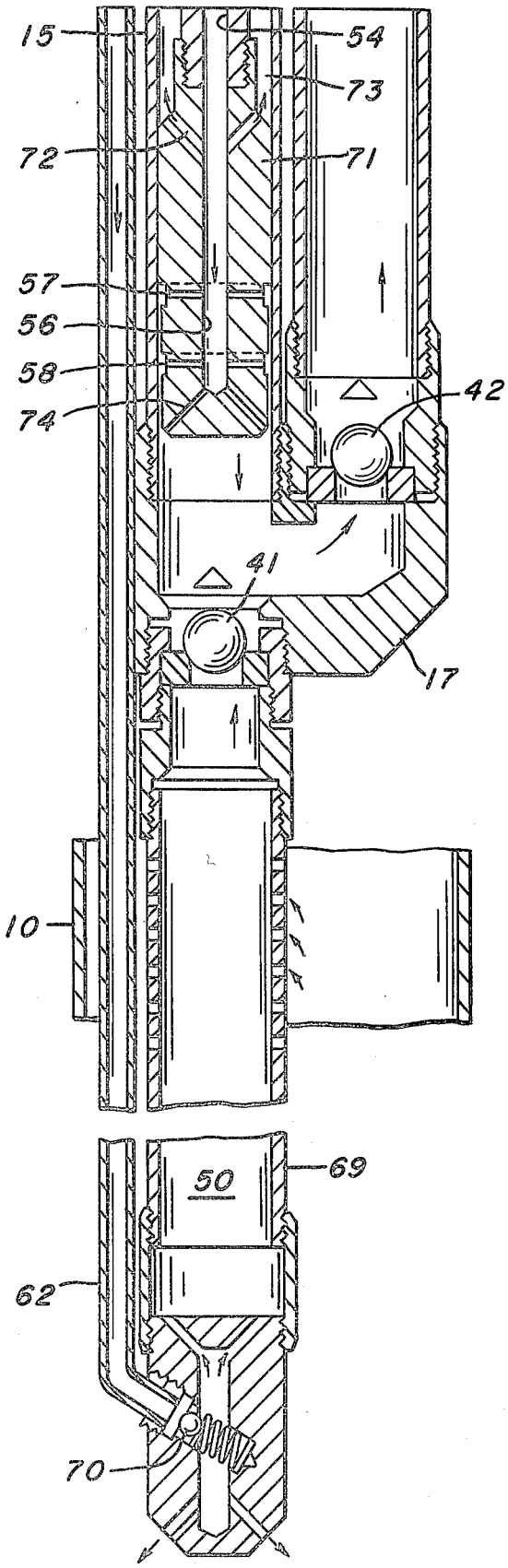
Figure 6:
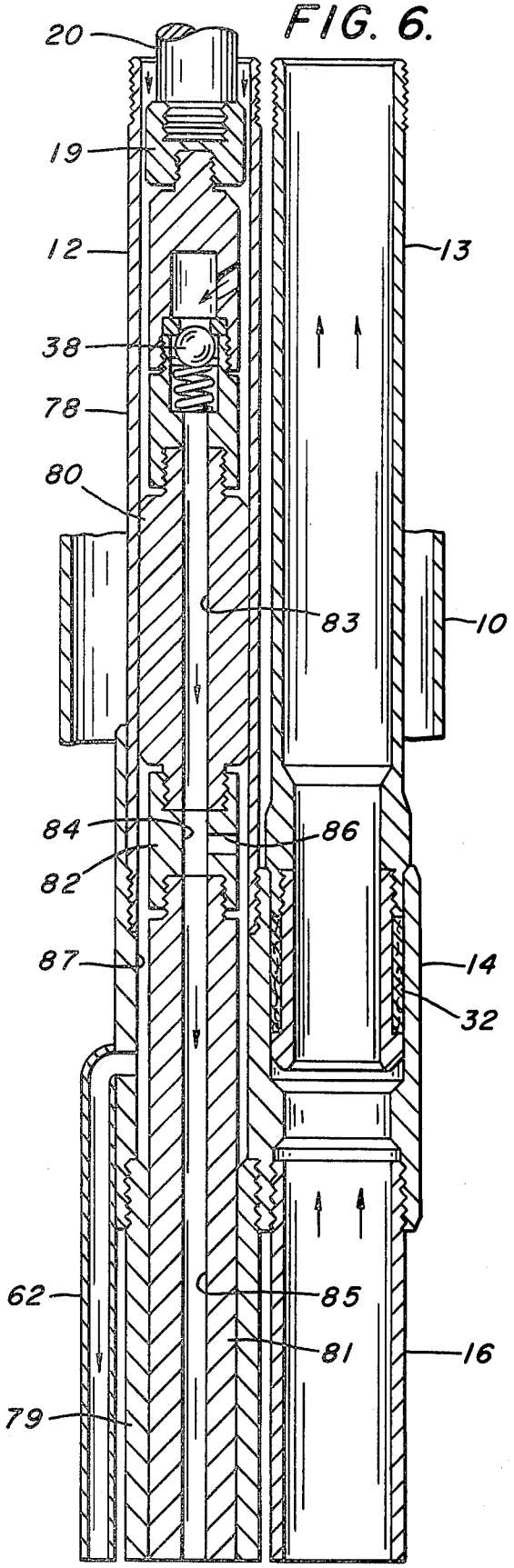
Figure 6A:
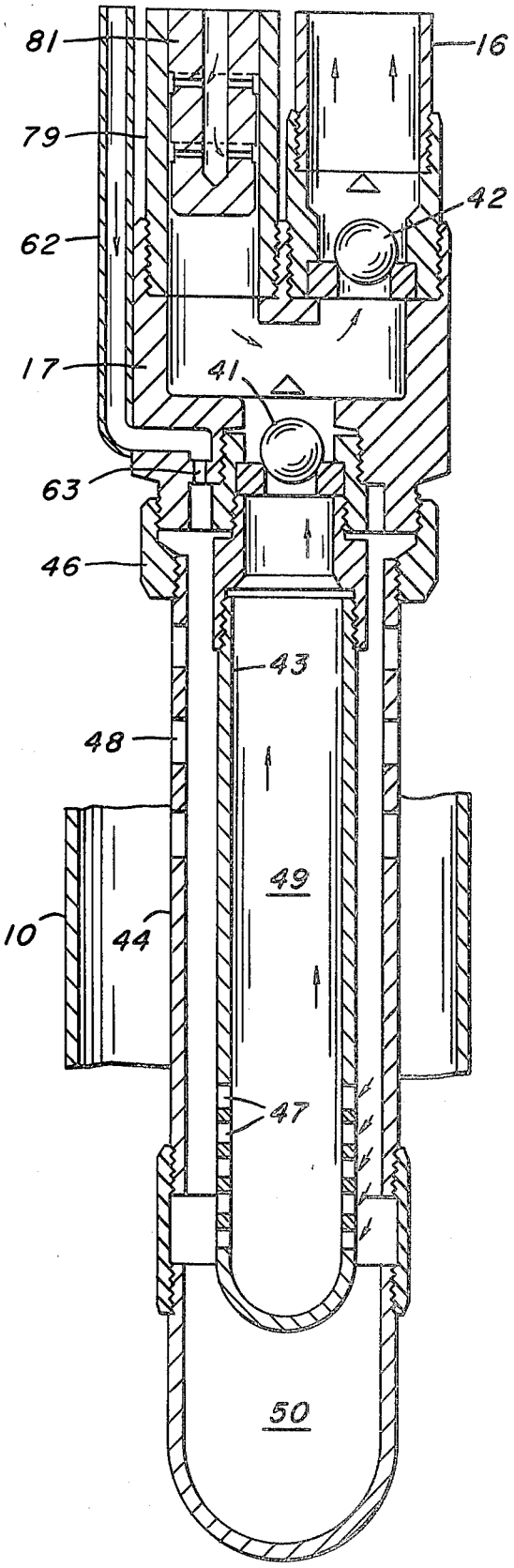

FIGS. 4 and 4A together are a more detailed diagrammatic vertical sectional view of one form of pumping installation constructed in accordance with the invention;

FIGS. 5 and 5A together are another view similar to FIGS. 4 and 4A, but showing a modification;

FIGS. 6 and 6A together are another similar view showing another modification; and FIG. 7 is a view similar to FIG. 2, but showing a landing shoe of modified construction.

Figure 1:
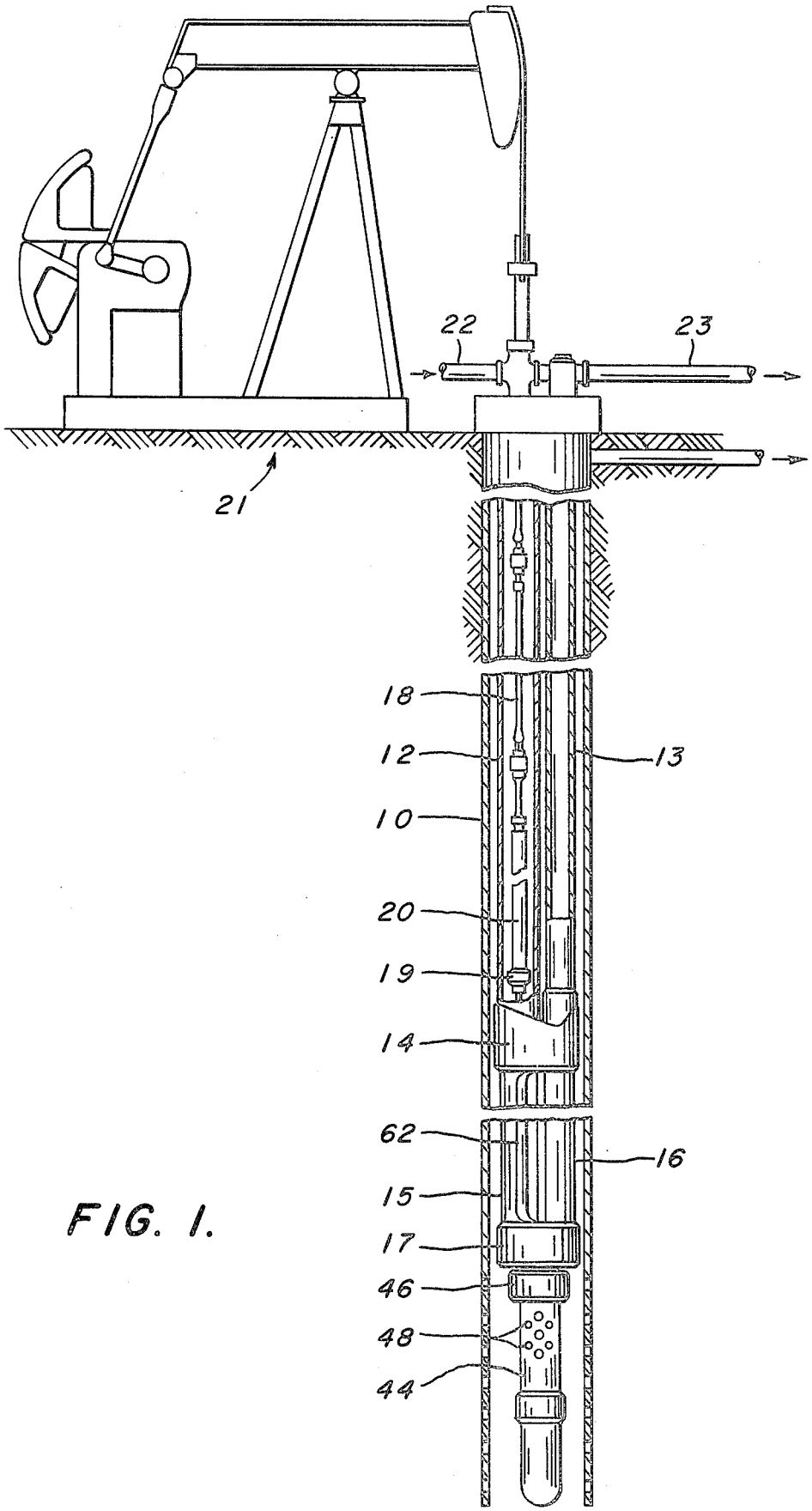
FIG. 1 is a diagrammatic vertical sectional view of a well equipped with a pumping installation constructed in accordance with the present invention.

FIG. 1 shows a casing 10 through which extend parallel power and production tubing strings 12 and 13 respectively. A landing shoe 14 is attached to the lower end of the power tubing string 12. The lower end of the production tubing string 13 carries means hereinafter described stabbed and locked in the landing shoe. A pump barrel 15 and a production tube extension 16 are attached to the lower end of the landing shoe 14 in line with the power and production tubing strings 12 and 13 respectively. The lower ends of both the pump barrel 15 and the extension 16 are attached to a crossover 17. Sucker rods 18 extend down the power tubing string 12 an are attached at their lower end to a guide fitting 19, preferably through inertia bars 20 which furnish added weight to assist in downstrokes of the pump. At the surface the sucker rods 18 are connected to a conventional pumping unit 21. A diluent inlet 22 and a production flow line 23 are connected to the power and production tubing strings 12 and 13 respectively.

FIGS. 2 and 3 show the landing shoe 14 in more detail. The landing shoe is of the bowl type, and its upper edges slope downwardly forming the outline of a cone, the apex 25 which lies on the central axis of the production tubing string 13. The landing shoe is threadedly connected at its left side to a nipple 26 which is attached to the lower end of the power tubing string 12. The right side of the landing shoe has internal arcuate cutouts 27 and undercut segments 28 circumferentially aligned with the cutouts. The stabbing and locking means includes mandrel 29 attached to the lower end of the production tubing string 13 with a coupling 30 and bushing 31. The mandrel carries packing rings 32 around its outer surface held in place with a lock nut 33, and it has integral arcuate lobes 34 extending from its outer surface above the packing rings.

When the production tubing string 13 is installed, the power tubing string 12 and landing shoe 14 already are in place, as hereinafter described. As the production tubing string is lowered into the casing 10, the lower end of the mandrel 29 abuts the conical upper edge of the landing shoe and thus is guided into alignment with the bore at the right side of the landing shoe and is stabbed therein. The lobes 34 enter the cutouts 27, after which the production tubing string is turned counterclockwise through an arc sufficient to turn the mandrel a quarter revolution and position the lobes within the undercut segments 28. This locks the production tubing string in the landing shoe, and the packing rings 32 afford a seal. When the production tubing string is pulled, it is turned clockwise to disengage the lobes. By reason of turning the mandrel clockwise to disengage it, there is no tendency to loosening the couplings of the production tubing string when the mandrel is disengaged.

As shown in FIGS. 4 and 4A, a check valve housing 37, which contains a check valve 38, is attached to the lower end of the guide fitting 19, and a pull tube 39 is attached to the lower end of this housing. A pump plunger 40 is attached to the lower end of the pull tube 39 for movement up and down within the barrel 15. Suction and discharge valves 41 and 42 are mounted within the crossover 17 and the extension 16 respectively. Spaced apart inner and outer caps 43 and 44 are attached to the lower end of the crossover 17 with a bushing 45 and a coupling 46 respectively, and have perforations 47 and 48 respectively. The interior of the inner cap 43 constitutes a suction chamber 49, and the interior of the outer cap 44 a mixing chamber 50.

The pull tube 39 has a bore 54. The check valve housing 37 has a port 55 affording communication between the power tubing string 12 and the bore 54. The plunger 40 has a bore 56 which forms a continuation of bore 54. The plunger also has upper and lower sets of ports 57 and 58 which furnish communication between its bore 56 and its outer circumference. The plunger has a relatively long upper segment 59 above its upper ports 57, a shorter middle segment 60 between its upper and lower ports 57 and 58, and a bottom segment 61 below the lower ports 58. The upper segment 59 has a close clearance with the barrel 15, the middle segment 60 a greater clearance, and the bottom segment 61 a still greater clearance, as shown exaggerated in FIG. 4A. A bypass tube 62 is connected at its upper or diluent-receiving end with the landing shoe 14 at the left side of the latter, that is, the side to which the power tubing string 12 is attached. The bypass tube is connected at its lower or discharge end to the crossover 17, which has a metering orifice 63 affording communication between the bypass tube and the mixing chamber 50.

In operation, the pumping unit 21 alternately raises and lowers the sucker rods 18, pull tube 39 and plunger 40 through upstrokes and downstrokes in the usual fashion. On each upstroke well fluid is drawn into the pump barrel 15 through the perforations 47 and 48 in the caps 43 and 44 and through the suction valve 41. On each downstroke fluid is forced from the pump barrel through the crossover 17 and discharge valve 42 into the extension 16 and production tubing string 13 and ultimately to the surface. The power tubing string 12 carries diluent from the surface into the well. The diluent acts directly on the top of the plunger 40, and thus its weight assists in providing the energy necessary for the pump to make its downstroke. When the installation is equipped with inertia bars 20 as illustrated, their weight lends further assistance.

A portion of the diluent enters bores 54 and 56 in the pull tube 39 and plunger 40 through the port 55 and check valve 38. The check valve prevents such fluid from backing up during a downstroke. Although the check valve conveniently is located near the top of the pull tube as illustrated, it could be located further down or within the plunger. Bores 54 and 56 conduct the diluent to ports 57 and 58 through which it discharges into the pump barrel 15 where, as already pointed out, the clearance between the plunger and barrel is greater than the clearance above these ports. The smaller clearance thereabove prevents upward flow past the plunger on the downstroke. Consequently diluent which discharges through ports 57 and 58 flows downwardly around the middle and bottom segments 60 and 61 of the plunger into the crossover 17. The diluent is under high pressure by reason of its own weight optionally augmented by applying pressure at the surface. Hence the diluent acts as a barrier which effectively excludes well fluid and contaminants from the working parts of the pump. It is critical that the passages through which diluent reaches the lower portion of the pump barrel are restricted; otherwise diluent would escape during upstrokes when the check valves 38 open.

The remaining portion of the diluent flows from the power tubing string 12 into the bypass tube 62 and is conducted to the metering orifice 63 through which it discharges into the mixing chamber 50. This diluent blends with the well fluid drawn into the mixing chamber through the perforations 48 to produce a diluted mixture of a viscosity which the pump can handle readily. The metering orifice limits the volume of diluent which mixes with the well fluid to an economical ratio, and also provides a jet action to promote better mixing. After the mixture passes the suction valve 41, it is further diluted wiith diluent which reaches the crossover 17 through the pull tube and plunger. The production tubing string 13 carries the mixture of well fluid and diluent to the surface.

When the pump is installed in a well, the barrel 15 and parts therebelow are set on the landing shoe 14 at the end of the power tubing string 12 and easily run into the well. With these parts in place, the production tubing string 13 is run and the mandrel 29 is stabbed and locked in the landing shoe 14 as already described. The pull tube 39 and plunger 40 are run on the sucker rods 18 and hung several feet above the barrel. Diluent then can be circulated down the power tubing string, through the pump barrel 15 and crossover 17, and up the extension 16 and production tubing string 13 to clean the system prior to starting the pumping operation. At any other time during operation of the pump, the plunger can be raised from the barrel and diluent circulated in similar fashion to clean the system. No on-off sucker rod tool is needed to connect the sucker rods to the pull tube or plunger.

Before the pump is retrieved, the system preferably again is cleaned as just described. The pump then is retrieved by first pulling the sucker rods 18, pull tube 39 and plunger 40. At this time the power tubing string drains through the bores 54 and 56 and ports 57 and 58 and also through the bypass tube 62, but drainage is slow since fluid in the power tubing string can drain only through restricted openings. If faster drainage is desired, the mandrel 29 can be unseated from the landing shoe 14 before the sucker rods are pulled. Next the production tubing string 13 is pulled, and finally the power tubing string 12 and parts attached thereto.

FIGS. 5 and 5A show a modified pumping installation which has a packoff 67 within the left side of the landing shoe 68 surrounding the pull tube 39, and also in which the cap 69 carries a control valve 70 at its lower end where the bypass 62 enters. The inner cap is dispensed with in this modification. The plunger 71 has additional ports 72 which are directed upwardly to afford communication between its bore and an annular chamber 73 between the plunger and packoff 67. On a downstroke of the plunger 71 diluent is drawn into chamber 73 from the bore in the plunger through the ports 72. The control valve 70 prevents well fluid in the mixing chamber 50 from being drawn into the chamber through the bypass tube 62. On an upstroke the plunger 71 forces the diluent from the chamber through the bypass tube 62 and valve 70 into the mixing chamber 50. The plunger 71 is shown as having additional ports 74 directed downwardly through which diluent is introduced directly to the pump barrel 15 below the plunger. It is apparent that similar downwardly directed ports could be included in the embodiment shown in FIGS. 4 and 4A.

FIGS. 6 and 6A show another modified pumping installation which has upper and lower barrels 78 and 79, upper and lower plungers 80 and 81 within the respective barrels, and a coupling 82 joining the two plungers. The upper plunger, coupling, and lower plunger have bores 83, 84 and 85 respectively. The coupling has a port 86 affording communication between its bore 84 and the upper pump barrel 78. The space within the upper barrel and the landing shoe 14 below the upper plunger 80 constitutes as annular chamber 87. On an upstroke of the plungers diluent is drawn into the annular chamber from the bores through port 86. On a downstroke the upper plunger forces the diluent from this chamber through the bypass tube 62 into the mixing chamber 50. Diluent reaches the lower portion of the lower barrel 79 by the same routes as described in connection with FIGS. 4, 4A, 5 and 5A.

In both modifications shown in FIGS. 5, 5A, 6 and 6A diluent is forced under additional positive pressure through the bypass tube into the mixing chamber. In FIGS. 5 and 5A this occurs on the upstroke, while in FIGS. 6 and 6A it occurs on the downstroke. The parts not described in detail in these figures operate similarly to corresponding parts of the embodiments shown in FIGS. 4 and 4A and are designated by the same reference numerals.

FIG. 7 shows a modification in which a landing shoe 90 is threadedly connected at its right side to the lower end of the production tubing string 13, and the lower end of the power tubing string 12 carries means stabbed and locked in the landing shoe at its left side. The upper edges of the landing shoe 90 slope downwardly forming the outline of a cone, as in the landing shoe already described, but the apex 91 of the cone lies on the central axis of the power tubing string 12. The landing shoe 90 has cutouts and undercut segments 92 similar to those already described, but located at the opposite side. The stabbing and locking means includes a mandrel 93 attached to the lower end of the power tubing string 12 with a coupling 94. The mandrel carries packing rings 96 around its outer surface held in place with a lock nut 97, and it has integral arcuate lobes 98 extending from its outer surface above the packing rings, all similar to corresponding parts of the embodiment already described.

When the power tubing string 12 is installed, the production tubing string 13 and landing shoe 90 already are in place. The power tubing string is lowered into the casing 10 and the mandrel 93 is stabbed into the landing shoe and locked in place by a procedure similar to that already described. Thereafter the sucker rods 18 and parts attached thereto are run into the power tubing string.

The modified arrangement of the landing shoe shown in FIG. 7 can be used with pumps of the construction shown in any of FIGS. 4, 4A, 5, 5A, 6 and 6A.

Any of the embodiments illustrated can operate with the bypass tube omitted. When the bypass tube is omitted, diluent reaches the lower portion of the pump barrel by the route through the plunger already described, and acts as a barrier in the same fashion. The diluent mixes with the well fluid only within the crossover 17.

From the foregoing description it is seen that the present invention provides a pumping installation of simplified construction which avoids complex parts. Nevertheless the installation effectively blends solvent or diluent with viscous or sand-laden well fluid enabling such fluid to be pumpted readily, but keeping the well fluid out of the working parts of the pump. The parts are easily installed in a well or retrieved therefrom. The landing shoe and the crossover have the largest cross section yet fit readily within a casing.

I claim:

1. In a subsurface pumping installation which includes:

parallel power and production tubing strings;

a pump barrel at the lower end of said power tubing string;

sucker rods extending down said power tubing string;

a plunger movable up and down within said barrel;

means connecting said plunger with said sucker rods;

a crossover affording communication between said pump barrel and said production tubing string;

said power tubing string being adapted to carry diluent from the surface into a well;

means for transmitting at least a portion of the diluent to said barrel beneath said plunger and thence to said crossover; and valves for admitting well fluid to said crossover and discharging it therefrom on opposite movements of said plunger;

said production tubing string being adapted to carry a mixture of well fluid and diluent to the surface;

the improvement comprising:

a landing shoe attached to one of said tubing strings at the lower end thereof;

means carried by the other of said tubing strings at the lower end thereof stabbed and locked in said landing shoe;

said landing shoe having upper edges which slope downwardly toward the central axis of said other tubing string to guide said last-named means into the landing shoe as said other tubing string is lowered; and tubular means connecting said crossover and said landing shoe.

2. An improvement as defined in claim 1 in which said landing shoe is attached at one side to the lower end of said power tubing string, and the means stabbed and locked in said landing shoe is carried by the lower end of said production tubing string.

3. An improvement as defined in claim 1 in which said landing shoe is attached at one side to the lower end of said production tubing string, and the means stabbed and locked in said landing shoe is carried by the lower end of said power tubing string.

4. An improvement as defined in claim 1 comprising in addition a mixing chamber below said crossover for receiving well fluid, and bypass means through which a portion of the diluent is carried to said mixing chamber to blend with well fluid therein.

5. An improvement as defined in claim 4 in which bypass means has a diluent-receiving end connected to said landing shoe.

6. An improvement as defined in claim 4 in which said valves include a suction valve located at the bottom of said crossover between said mixing chamber and said crossover, and a discharge valve located at the top of said crossover between said crossover and said tubular means.

7. An improvement as defined in claim 4 comprising in addition a metering orifice between said bypass means and said mixing chamber.

8. An improvement as defined in claim 4 comprising in addition means for forcing the diluent under additional positive pressure through said bypass means into said mixing chamber.

9. An improvement as defined in claim 8 in which the means for forcing the diluent under pressure includes a packoff for said plunger above said barrel and said bypass means, and a control valve in said bypass means, the diluent being forced on upstrokes of said plunger.

10. An improvement as defined in claim 8 in which the means for forcing the diluent under pressure includes a second barrel and plunger above said first-named barrel and plunger, said bypass means being connected to said second barrel, the diluent being forced on downstrokes of said plungers.

11. An inprovement as defined in claim 1 in which the means connecting said plunger with said sucker rods includes a pull tube having a bore communicating with said power tubing string and said plunger has a bore communicating with the bore in said pull tube and comprising in addition a check valve to prevent diluent from backing up through said bores on a downstroke of said plunger.

12. An improvement as defined in claim 11 in which said plunger has ports affording communication between its bore and said barrel, said plunger having greater clearance with said barrel below said ports than above said ports.

13. In subsurface pumping installation which includes:

parallel power and production tubing strings;

a pump barrel at the lower end of said power tubing string;

sucker rods extending down said power tubing string;

a plunger movable up and down within said barrel;

means connecting said plunger with said sucker rods;

a crossover affording communication between said pump barrel and said production tubing string;

said power tubing string being adapted to carry diluent from the surface into a well;

means for transmitting at least a portion of the diluent to said barrel beneath said plunger and thence to said crossover; and valves for admitting well fluid to said crossover and discharging it therefrom on opposite movements of said plunger;

said production tubing string being adapted to carry a mixture of well fluid and diluent to the surface;

the improvement comprising:

a landing shoe attached to one of said tubing strings at the lower end thereof;

a mandrel carried by the other of said tubing strings at the lower end thereof and stabbed and locked in said landing shoe;

packing rings and lobes on said mandrel;

said landing shoe having cutouts for receiving said lobes as said mandrel is stabbed in the landing shoe, and undercut segments circumferentially aligned with said cutouts receiving said lobes on rotation of said mandrel to lock the mandrel in the landing shoe; and tubular means connecting said crossover and said landing shoe.

14. In a subsurface pumping installation which includes parallel power and production tubing strings, a pump barrel at the lower end of said power tubing string, sucker rods extending down said power tubing string, a plunger movable up and down within said barrel, means connecting said plunger with said sucker rods, and a crossover affording communication between said pump barrel and said production tubing string, said power tubing string being adapted to carry diluent from the surface into a well, said production tubing string being adapted to carry a mixture of well fluid and diluent to the surface, the improvements comprising:

said connecting means and said plunger having a passage for receiving diluent from said power tubing string;

said plunger having a segment in its upper portion making close clearance with said barrel and at least one segment below said first-named segment making a greater clearance with said barrel;

said plunger having restricted ports affording communication between said passage and its outer circumference in the segment making greater clearance to introduce diluent to said barrel beneath said plunger and exclude well fluid therefrom;

means below said barrel for mixing diluent with well fluid;

a landing shoe attached to one of said tubing strings at the lower end thereof at a level above said pump barrel;

means carried by the other of said tubing strings at the lower end thereof stabbed and locked in said landing shoe;

said landing shoe having upper edges which slope downwardly forming the outline of a cone, the apex of which lies on the central axis of the tubing string which carries the means stabbed and locked in said landiing shoe; and a production tubing extension connecting said landing shoe and said crossover.

15. In a subsurface pumping installation which includes parallel power and production tubing strings, a pump barrel at the lower end of said power tubing string, sucker rods extending down said power tubing string, a plunger movable up and down within said barrel, means connecting said plunger with said sucker rods, and a crossover affording communication between said pump barrel and said production tubing string, said power tubing string being adapted to carry diluent from the surface into a well, said production tubing string being adapted to carry a mixture of well fluid and diluent to the surface, the improvements comprising:

said connecting means and said plunger having a passage for receiving diluent from said power tubing string;

said plunger having a segment in its upper portion making close clearance with said barrel and at least one segment below said first-named segment making a greater clearance with said barrel;

said plunger having restricted ports affording communication between said passage and its outer circumference in the segment making greater clearance to introduce diluent to said barrel beneath said plunger and exclude well fluid therefrom;

means below said barrel for mixing diluent with well fluid;

a landing shoe attached to one of said tubing strings at the lower end thereof at a level aove said pump barrel;

a mandrel attached to the other of said tubing strings at the lower end thereof stabbed and locked in said landing shoe;

packing rings and lobes on said mandrel;

said landing shoe having cutouts for receiving said lobes as said mandrel is stabbed in the landing shoe and undercut segments circumferentially aligned with said cutouts receiving said lobes on rotation of said mandrel to lock the mandrel in the landing shoe; and a production tubing extension connecting said landing shoe and said crossover.

16. In a subsurface pumping installation which includes parallel power and production tubing strings, a pump barrel at the lower end of said power tubing string, sucker rods extending down said power tubing string, a plunger movable up and down within said barrel, means connecting said plunger with said sucker rods, and a crossover affording communication between said pump barrel and said production tubing string, said power tubing string being adapted to carry diluent from the surface into a well, said production tubing string being adapted to carry a mixture of well fluid and diluent to the surface, the improvement comprising:

means for transmitting at least a portion of the diluent to said pump barrel beneath said plunger;

means below said plunger for mixing diluent and well fluid;

a landing shoe connected with one of said tubing strings and receiving the lower end of the other of said tubing strings;

said landing shoe having upper edges which slope downwardly forming the outline of a cone, the apex of which lies on the central axis of the tubing string received therein.

* * * * *